US009111527B2

(12) United States Patent
Oshikiri

(10) Patent No.: US 9,111,527 B2
(45) Date of Patent: Aug. 18, 2015

(54) ENCODING DEVICE, DECODING DEVICE, AND METHODS THEREFOR

(75) Inventor: Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 911 days.

(21) Appl. No.: 13/318,552

(22) PCT Filed: May 19, 2010

(86) PCT No.: PCT/JP2010/003367

§ 371 (c)(1),
(2), (4) Date: Nov. 2, 2011

(87) PCT Pub. No.: WO2010/134332

PCT Pub. Date: Nov. 25, 2010

(65) Prior Publication Data

US 2012/0045067 A1 Feb. 23, 2012

(30) Foreign Application Priority Data

May 20, 2009 (JP) ..... 2009-122147

(51) Int. Cl.
*G10L 19/008* (2013.01)

(52) U.S. Cl.
CPC ..... *G10L 19/008* (2013.01)

(58) Field of Classification Search
CPC ... G10L 19/0017; G10L 19/008; G10L 19/04; H04B 14/046; H04S 1/007; H04S 3/00; H04N 5/602
USPC ..... 381/22, 23, 71.11; 704/219, 201, 500, 704/501
See application file for complete search history.

(56) References Cited

U.S. PATENT DOCUMENTS 4,815,132 A * 3/1989 Minami ..... 381/1
5,434,948 A * 7/1995 Holt et al. ..... 704/220

(Continued)

FOREIGN PATENT DOCUMENTS

JP 11-509388 8/1999
JP 2008-529056 7/2008

OTHER PUBLICATIONS

S. Minami, O. Okuda, "Stereophonic ADPCM Voice Coding Method", IEEE International Conference on Acoustics, Speech and Signal Processing 1990, Apr. 1990, pp. 1113-1116.

(Continued)

*Primary Examiner* — Fan Tsang
*Assistant Examiner* — Eugene Zhao
(74) *Attorney, Agent, or Firm* — Greenblum & Bernstein, P.L.C.

(57) ABSTRACT

An encoding device, a decoding device, and encoding and decoding methods are provided, wherein when a multi-channel signal is encoded with high efficiency, using an adaptive filter, the number of arithmetic operations to update a filter coefficient of the adaptive filter can be reduced. An update range determination unit determines the range of a filter coefficient order (update order range) of a filter coefficient to be updated, among filter coefficients $g_k(n)$ of the adaptive filter, on the basis of a mutual correlation function between an input (L) signal and an input (R) signal. The adaptive filter updates the filter coefficient $g_k(n)$ of the filter coefficient order (n) to be updated, using a decoding (L) signal and a decoding error (R) signal.

25 Claims, 11 Drawing Sheets

(56) References Cited

U.S. PATENT DOCUMENTS

| | | | | |
|---|---|---|---|---|
| 6,360,200 | B1 | 3/2002 | Edler et al. | |
| 7,822,617 | B2 | 10/2010 | Taleb et al. | |
| 7,945,055 | B2 | 5/2011 | Taleb et al. | |
| 2006/0195314 | A1 | 8/2006 | Taleb et al. | |
| 2006/0246868 | A1 | 11/2006 | Taleb et al. | |
| 2008/0232439 | A1* | 9/2008 | Chen | 375/148 |
| 2008/0262850 | A1 | 10/2008 | Taleb et al. | |
| 2010/0106493 | A1* | 4/2010 | Zhou et al. | 704/219 |

OTHER PUBLICATIONS

International Search Report, mailed Aug. 10, 2010, for corresponding International Patent Application PCT/JP2010/003367.

* cited by examiner

ENCODING DEVICE, DECODING DEVICE, AND METHODS THEREFOR

TECHNICAL FIELD

The present invention relates to an encoding apparatus, a decoding apparatus, and a method thereof for achieving highly efficient encoding of a multi-channel signal using an adaptive filter.

BACKGROUND ART

In a mobile communication system, speech signals are requested to be compressed into low bit rates for transmission so as to efficiently utilize radio wave resources and so on. On the other hand, improvement of speech call audio quality and achievement of high quality realistic speech call service are desired. To achieve them, not only a mono signal but also multi-channel audio signals, in particular stereo audio signals, are desirably encoded with high quality.

A method using correlation between channels is effective to encode stereo audio signal (two-channel audio signals) or multi-channel audio signals with low bit rates. A method for backward adaptive prediction of a signal in a channel from a signal in another channel using an adaptive filter is known as a method using correlation between channels (see non-Patent Literature 1 and Patent Literature 1).

In this method, when a signal reaches a left microphone and a right microphone from a sound source, acoustic characteristics between a sound source-a left microphone and between the sound source-a right microphone is estimated using an adaptive filter. A FIR (Finite Impulse Response) filter is used as the adaptive filter.

An estimation method using the adaptive filter will be hereinafter explained using an example where acoustic characteristic of a stereo audio signal are estimated.

In FIG. 1, $H_L(z)$ represents acoustic characteristic between a sound source and a left microphone, and $H_R(z)$ represents acoustic characteristic between the sound source and a right microphone. If the right signal is estimated from the left signal using the adaptive filter, a transfer function G(z) of the adaptive filter is configured to satisfy the relationship of equation 1 with regard to $H_L(z)$ and $H_R(z)$.

(Equation 1)

$$G(z) = \frac{H_R(z)}{H_L(z)} \quad [1]$$

Using the adaptive filter having the transfer function G(z) satisfying equation 1, the right signal is estimated from the left signal, and the estimated error is quantized. In this manner, using the adaptive filter, the correlation between the left signal and the right signal is removed, whereby efficient encoding can be achieved.

The transfer function G(z) of the adaptive filter is expressed as equation 2.

(Equation 2)

$$G(z) = \sum_{n=0}^{N-1} g_k(n) \cdot z^{-n} \quad [2]$$

In equation 2, $g_k(n)$ denotes the n-th (filter coefficient order n) filter coefficient of the adaptive filter at time k, z denotes a Z-transformation variable, and N denotes a filter order of the adaptive filter (the maximum value of filter coefficient order n).

The adaptive filter estimates acoustic characteristic while successively updating the filter coefficient in units of sample processings. When learning identification method (NLMS (normalized least-mean-square)) algorithm is used to update the filter coefficient of the adaptive filter, filter coefficient $g_k(n)$ of the adaptive filter is updated according to equation 3.

(Equation 3)

$$g_{k+1}(n) = g_k(n) + \frac{\alpha}{\sum_{i=0}^{N-1} x_k(i)^2 + \beta} \cdot e(k) \cdot x_k(n) \text{ (for all } n) \quad [3]$$

As described above, $g_k(n)$ denotes the n-th (filter coefficient order n) filter coefficient of the adaptive filter at time k, and N denotes the filter order of the adaptive filter (the maximum value of filter coefficient order n). On the other hand, e(k) denotes an error signal at time k, and $x_k(n)$ denotes an input signal at time k multiplied by the n-th (filter coefficient order n) filter coefficient of the adaptive filter. $\alpha$ denotes a parameter for controlling update speed of the adaptive filter, and $\beta$ denotes a parameter for preventing a denominator of equation 3 from being zero. $\beta$ is a positive value.

At this occasion, the filter order N of the adaptive filter needs to be determined according to acoustic characteristic between the sound source and the microphone. For example, it is necessary to represent acoustic characteristic for a time length of about 100 ms in order to ensure sufficient performance. In this case, the filter coefficient of the adaptive filter needs to have a filter order N for the time length of 100 ms. Accordingly, when the sampling frequency of the input signal is 32 kHz, the filter order N of the adaptive filter required to obtain the acoustic characteristic for the time length of 100 ms is 3200.

CITATION LIST

Patent Literature

PTL 1
Published Japanese Translation No. H11-509388 of the PCT International Publication

Non-Patent Literature

NPL 1
S. Minami, O. Okuda, "Stereophonic ADPCM Voice Coding Method", IEEE International Conference on Acoustics, Speech, and Signal Processing 1990 (ICASSP 1990), April, 1990, pp. 1113-1116

SUMMARY OF INVENTION

Technical Problem

However, the numbers of operations required to update the filter coefficient N of the adaptive filter using equation 3 are as follows: (N+1) times of additions, 3N times of multiplications, and 1 time of divisions per sample. If the filter order N is 3200, it is necessary to perform addition for 3201 times and multiplication for 9600 times, which greatly increases the load of the amount of operations.

As described above, using the adaptive filter, the correlation between the channels is removed, whereby the bit rate of encoding can be reduced. On the other hand, there is a problem in that a large amount of operation is required in updating the filter coefficient of the adaptive filter.

An object of the present invention is to provide an encoding apparatus, a decoding apparatus, and a method thereof capable of reducing the amount of update operation for updating a filter coefficient of an adaptive filter when a multi-channel signal is encoded with high efficiency using the adaptive filter.

Solution to Problem

An encoding apparatus according to the present invention employs a configuration including: a first encoding section that generates first encoded information by encoding a first channel signal; a first decoding section that generates a first decoded signal by decoding the first encoded information; an adaptive filter that performs filter processing on the first decoded signal, and generates a predicted signal of the second channel signal; an error signal generating section that generates an error signal by obtaining an error between the second channel signal and the predicted signal; a second encoding section that generates second encoded information by encoding the error signal; and a second decoding section that generates a decoded error signal by decoding the second encoded information, the encoding apparatus further including a determining section that determines, as an update order range, a range of filter coefficient orders of filter coefficients to be updated among filter coefficients used in the filter processing, and the adaptive filter updates the filter coefficients of the filter coefficient orders included in the update order range, using the first decoded signal and the decoded error signal.

A decoding apparatus according to the present invention employs a configuration including: a first decoding section that generates a first decoded signal by decoding first encoded information relating to a first channel signal; an adaptive filter that generates a predicted signal by performing filter processing on the first decoded signal; a second decoding section that generates a decoded error signal by decoding second encoded information relating to a second channel signal; and an adding section that generates a second decoded signal by adding the decoded error signal and the predicted signal, and the adaptive filter uses the first decoded signal and the decoded error signal to update filter coefficients of filter coefficient orders included in a received update order range of filter coefficient orders among the filter coefficients used in the filter processing.

An encoding method according to the present invention includes: a first encoding step that generates first encoded information by encoding a first channel signal; a first decoding step that generates a decoded signal by decoding the first encoded information; a filtering step that performs filter processing on the decoded signal, and generates a predicted signal of the second channel signal; an error signal generating step that generates an error signal by obtaining an error between the second channel signal and the predicted signal; a second encoding step that generates second encoded information by encoding the error signal; a second decoding step that generates a decoded error signal by decoding the second encoded information; a determining step that determines, as an update order range, a range of filter coefficient orders of filter coefficients to be updated among filter coefficients used in the filter processing; and an updating step that updates the filter coefficients of the filter coefficient orders included in the update order range, using the decoded signal and the decoded error signal.

A decoding method according to the present invention includes: a first decoding step that generates a first decoded signal by decoding first encoded information relating to a first channel signal; a filtering step that generates a predicted signal by performing filter processing on the first decoded signal; a second decoding step that generates a decoded error signal by decoding second encoded information relating to a second channel signal; an adding step that generates a second decoded signal by adding the decoded error signal and the predicted signal, an updating step that uses the first decoded signal and the decoded error signal to update filter coefficients of filter coefficient orders included in a specified update order range of filter coefficient orders among the filter coefficients used in the filter processing.

Advantageous Effects of Invention

According to the present invention, the amount of update operation for updating a filter coefficient of an adaptive filter can be reduced when a multi-channel signal is encoded with high efficiency using the adaptive filter.

DESCRIPTION OF EMBODIMENTS

Embodiments of the present invention will be hereinafter described with reference to drawings. In the explanation below, for example, a stereo audio signal is encoded/decoded. In the explanation, a channel used for prediction is a left signal (L signal), and a predicted channel is a right signal (R signal).

Embodiment 1

Figure 1:
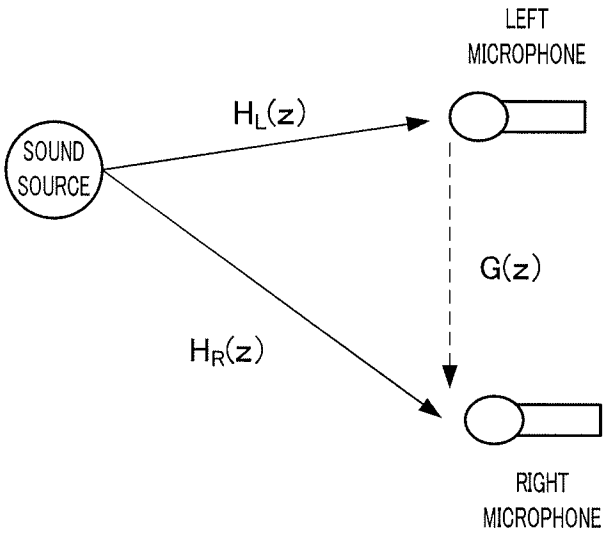
FIG. 1 is a figure for explaining a method for estimating acoustic characteristic of the stereo audio signal.
Figure 2:
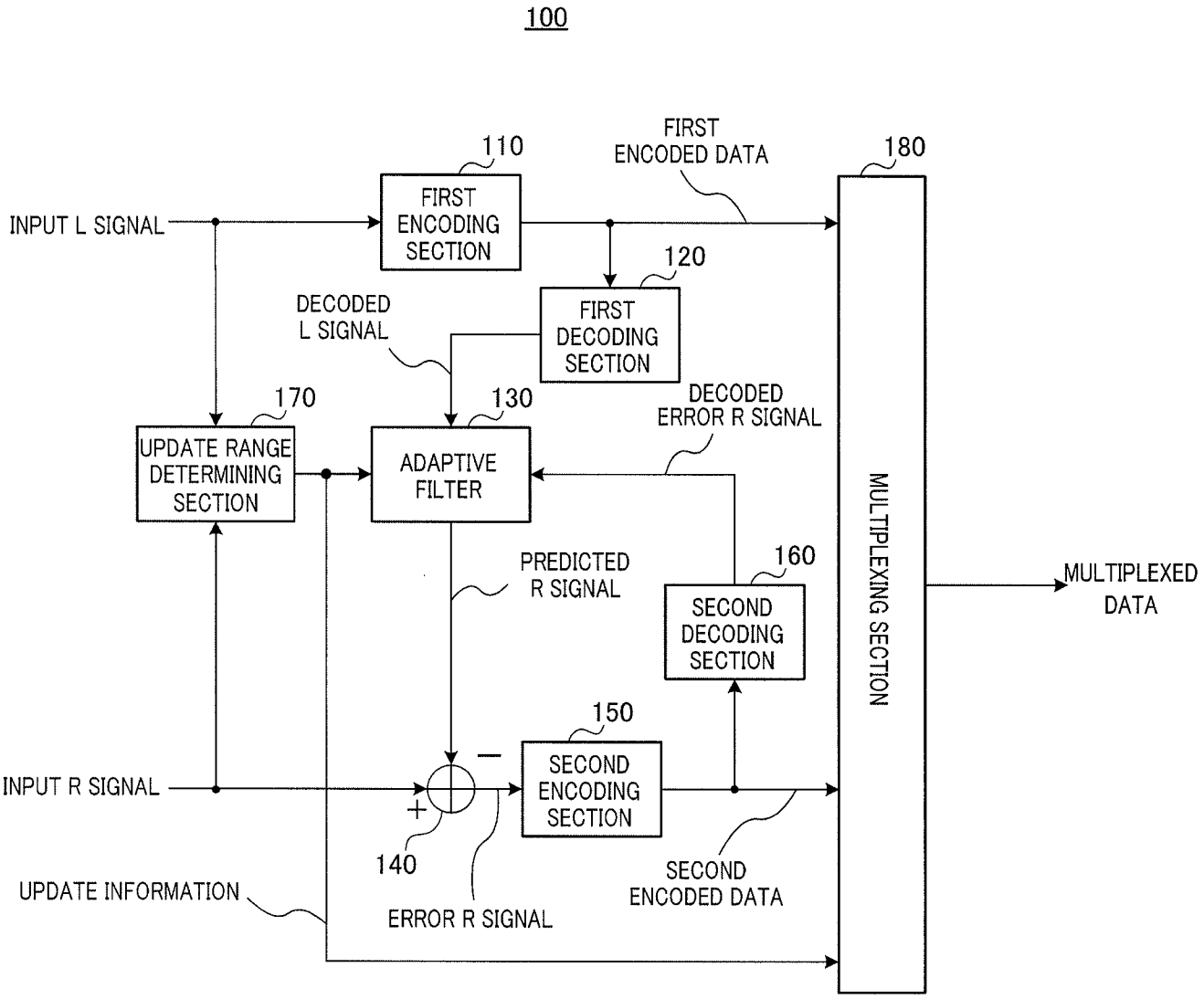
FIG. 2 is a block diagram illustrating a configuration of an essential portion of an encoding apparatus according to Embodiment 1 of the present invention.

FIG. 2 illustrates a configuration of an essential portion of an encoding apparatus according to the present embodiment. Encoding apparatus 100 as shown in FIG. 2 receives a stereo audio signal including a left channel signal and a right channel signal.

First encoding section 110 performs encoding processing on the received left channel signal (hereinafter referred to as "input L signal"), generates first encoded data, and outputs the first encoded data to multiplexing section 180. First encoding section 110 also outputs the first encoded data to first decoding section 120.

First decoding section 120 performs decoding processing on the first encoded data, and generates a decoded L signal. First decoding section 120 outputs the generated decoded L signal to adaptive filter 130.

Adaptive filter 130 has a transfer function expressed as equation 2, performs filter processing in units of sample processings on the decoded L signal, and generates a predicted R signal. The predicted R signal is generated using equation 4.

(Equation 4)

$$R'(k) = \sum_{n=0}^{N-1} g_k(n) \cdot L_{dec}(k-n) \quad [4]$$

In this case, $L_{dec}(k)$ denotes the decoded L signal at time k, and $g_k(n)$ denotes the n-th (filter coefficient order n) filter coefficients of adaptive filter 130 at time k, and R'(k) denotes the predicted R signal at time k.

As can be seen from equation 4, the predicted R signal is obtained by convolution operation of the filter coefficients of adaptive filter 130 and the decoded L signal. Adaptive filter 130 outputs the generated predicted R signal to subtraction section 140.

Further, adaptive filter 130 uses decoded error R signal and decoded L signal to update the filter coefficients of adaptive filter 130, thus preparing for processing of subsequent input signal. In this case, adaptive filter 130 updates only filter coefficients $g_k(n)$ of filter coefficient orders n included in the range of filter coefficient orders n of the filter coefficients to be updated (update order range), which is indicated by update information explained later. The update method of the filter coefficients of adaptive filter 130 will be explained later.

Subtraction section 140 subtracts the predicted R signal from the received right channel signal (hereinafter "input R signal"), and generates an error R signal. Subtraction section 140 outputs the generated error R signal to second encoding section 150.

Second encoding section 150 performs encoding processing on the error R signal, and generates second encoded data. Second encoding section 150 outputs the second encoded data to multiplexing section 180. Second encoding section 150 also outputs the second encoded data to second decoding section 160.

Second decoding section 160 performs decoding processing on the second encoded data, and generates the decoded error R signal. Second decoding section 160 outputs the generated decoded error R signal to adaptive filter 130.

Update range determining section 170 uses the input L signal and the input R signal to obtain a cross-correlation function therebetween. Then, update range determining section 170 determines the range of filter coefficient orders n of the filter coefficients to be updated (update order range) among filter coefficients $g_k(n)$ of adaptive filter 130 using the cross-correlation function. A determining method for determining the update order range will be explained later. Update range determining section 170 outputs information indicating the determined update order range (hereinafter "update information") to adaptive filter 130 and multiplexing section 180.

Multiplexing section 180 generates multiplexed data by multiplexing the first encoded data, the second encoded data, and the update information, and outputs the generated multiplexed data to a communication path, not shown.

Subsequently, the determining method for determining the range of the filter coefficient orders of the filter coefficients to be updated (update order range) among filter coefficients $g_k(n)$ of adaptive filter 130 and the update method for updating the filter coefficients will be explained.

Figure 3:
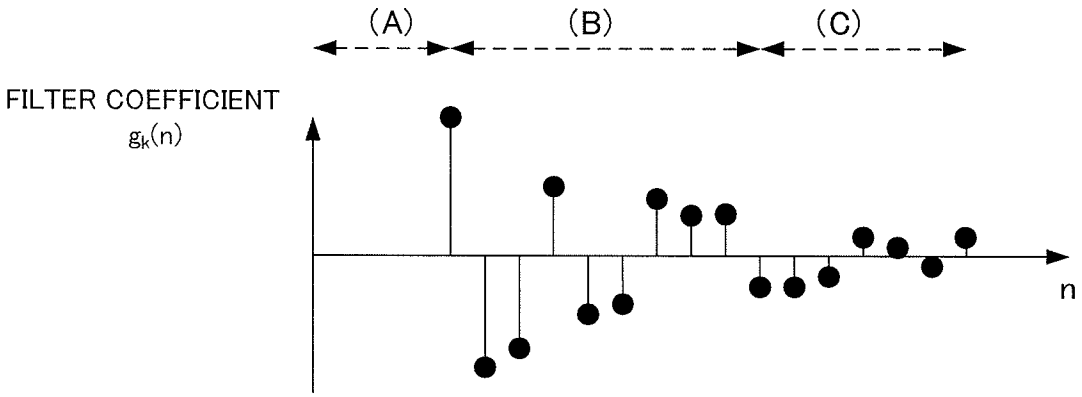
FIG. 3 is a figure illustrating an example of relationship between the magnitude of a filter coefficient $g_k(n)$ and a filter coefficient order n of an adaptive filter.

FIG. 3 illustrates an example of relationship between the magnitude of filter coefficient $g_k(n)$ and a filter coefficient order n of adaptive filter 130 when decoded L signal is input to adaptive filter 130 and the predicted R signal is output from adaptive filter 130. In FIG. 3, the horizontal axis represents filter coefficient order n of adaptive filter 130, and the vertical axis represents the magnitude of each filter coefficient $g_k(n)$.

As can be seen from FIG. 3, filter coefficient order n can be divided into three sections according to the magnitude of filter coefficient $g_k(n)$. In FIG. 3, the value of each filter coefficient is substantially zero in section (A). In other words, section (A) represents a section in which there is a time difference between the channel signal used for prediction and the predicted channel signal. Section (B) represents the first half of the filter coefficient order of adaptive filter 130, and in this section, the filter coefficient has a large value, representing an important component of the acoustic characteristic. In contrast, in section (C), each filter coefficient has a relatively small value, and section (C) is considered to be a section in which prediction performance of adaptive filter 130 is less affected.

As described above, filter coefficient order n of adaptive filter 130 can be classified into three sections, i.e., the section in which the prediction performance of adaptive filter 130 is not affected, the section in which the prediction performance of adaptive filter 130 is greatly affected, and the section in which the prediction performance of adaptive filter 130 is less affected, in accordance with the magnitude of the filter coefficient.

The present inventor pays attention to the magnitude of the filter coefficients of adaptive filter 130 and the effect to the prediction performance of adaptive filter 130, and, accordingly, limits the range of filter coefficient order n of which the filter coefficient is updated.

More specifically, in present Embodiment, the cross-correlation function between the channel signal used for prediction and the predicted channel signal is obtained, and based on the cross-correlation function thereof, filter coefficient order n included in section (A) and section (C) of FIG. 3 is identified. Filter coefficients $g_k(n)$ of filter coefficient orders n included in these sections are not updated. As described above, by limiting the range of the filter coefficient order of which the filter coefficient is updated, the amount of operation is reduced while maintaining the prediction performance.

Figure 4:
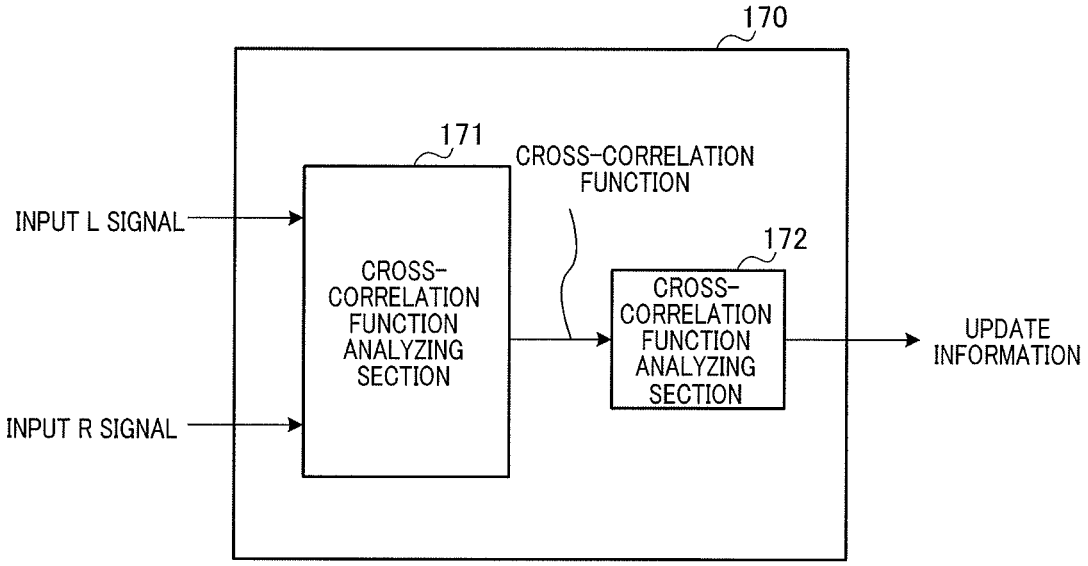
FIG. 4 is a block diagram illustrating an internal configuration of an update range determining section.

Specific internal configuration and operation of update range determining section 170 will be explained with reference to FIG. 4. FIG. 4 is a block diagram illustrating an internal configuration of update range determining section 170.

The input L signal and the input R signal are input to cross-correlation function analyzing section 171. Cross-correlation function analyzing section 171 obtains the cross-correlation function between the input L signal and the input R signal in accordance with equation 5.

(Equation 5)

$$C(m) = \sum_{i=0}^{J-1} L(i) \cdot R(i-m) \ (-M \le m \le M) \quad [5]$$

In equation 5, L(i) denotes an input L signal at time i. R(i) denotes an input R signal at time i. C(m) denotes a cross-correlation function at time difference m. J denotes an analysis length of the cross-correlation function. M denotes a calculation range of the cross-correlation function. Cross-correlation function analyzing section 171 calculates the cross-correlation function in units of sample processings. Therefore, the units of the time difference m, the analysis length J, and the calculation range M are sample processing units, which are the same as the processing unit of adaptive filter 130.

Cross-correlation function analyzing section 171 outputs the cross-correlation function thus calculated to cross-correlation function analyzing section 172.

Cross-correlation function analyzing section 172 determines the range of the filter coefficient orders of the filter coefficients to be updated (update order range) in filter coefficients $g_k(n)$ of adaptive filter 130 using the cross-correlation function, generates update information representing the determined update order range, and outputs the generated update information to adaptive filter 130 and multiplexing section 180.

It should be noted that the update order range determining processing of adaptive filter using the cross-correlation function may be performed with a predetermined time length interval of about 20 ms (this predetermined time length is referred to as a frame). In this case, the update order range determining processing may be performed for each frame, and therefore, this can suppress the increase of the update information and the amount of operation caused by this processing.

[Example of Determination of Update Order Range #1]

Figure 5:
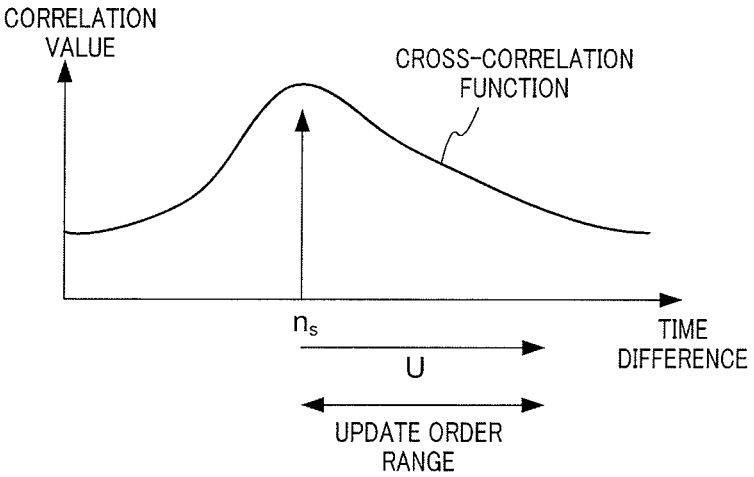
FIG. 5 is a figure for illustrating a determining method for determining an update order range of the filter coefficient of the adaptive filter.

As shown in FIG. 5, cross-correlation function analyzing section 172 detects the maximum value of the cross-correlation function, and obtains time difference $n_s$ when the cross-correlation function attains the maximum value. Time difference $n_s$ denotes a time difference between the input L signal and the input R signal. In other words, in FIG. 3 showing filter coefficient $g_k(n)$ of adaptive filter 130, time difference $n_s$ between the input L signal and the input R signal corresponds to a time difference (filter coefficient order) from the head of section (A) to the border between section (A) and section (B). Cross-correlation function analyzing section 172 generates the update information including indexes (symbols, numbers) for identifying time difference $n_s$.

Adaptive filter 130 updates the filter coefficients of adaptive filter 130 according to equation 6 based on the update information that is output from cross-correlation function analyzing section 172.

(Equation 6)

$$g_{k+1}(n) = g_k(n) + \frac{\alpha}{\sum_{i=0}^{N-1} L_{dec}(i)^2 + \beta} \cdot R_{e_dec}(k) \cdot L_{dec}(n) \ (n_s \le n < n_s + U) \quad [6]$$

In equation 6, $L_{dec}(n)$ denotes the decoded L signal multiplied with the n-th (filter coefficient order n) filter coefficient $g_k(n)$ of adaptive filter 130, and $R_{e_dec}(k)$ denotes the decoded error R signal at time k. On the other hand, $n_s$ denotes the time difference included in the update information, and U denotes a predetermined time, which represents the number of filter coefficients to be updated (the number of updates). In this case, only the filter coefficients $g_k(n)$ of filter coefficient orders n satisfying $n_s \le n < n_s + U (= n_e)$ are updated with equation 6. Therefore, in contrast to the conventional technique in which all the filter coefficients are updated, the amount of operation can be greatly reduced. Moreover, the filter coefficients of adaptive filter 130 that are included in important sections representing the acoustic characteristic are updated, and therefore, the reduction of the prediction performance of adaptive filter 130 can be avoided.

It should be noted that adaptive filter 130 leaves the values of the filter coefficients included in the non-updated section as they are. Alternatively, for example, adaptive filter 130 may perform processing for replacing the non-updated filter coefficients with zero or gradually change the non-updated filter coefficients to zero.

In addition, cross-correlation function analyzing section 172 may generate the update information representing the update order range in such a manner that the update information includes indexes (symbols, numbers) for identifying time difference $n_s$ and the number of updates U.

[Example of Determination of Update Order Range #2]

Figure 6:
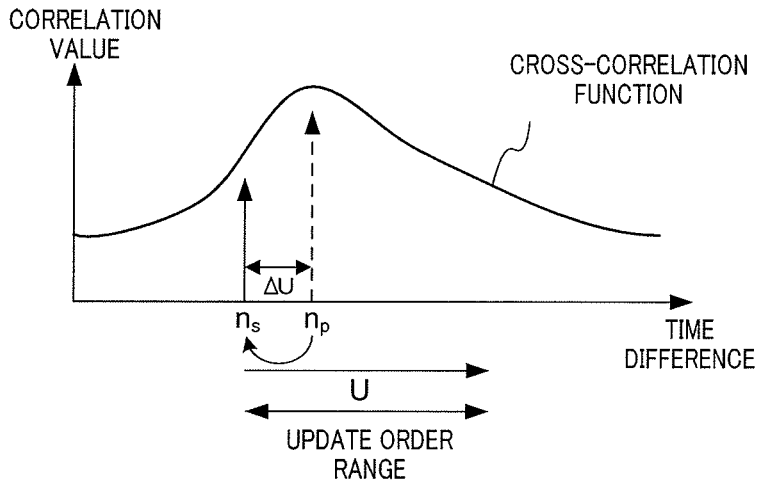
FIG. 6 is a figure for explaining a determining method for determining the update order range of the filter coefficient of the adaptive filter.

As shown in FIG. 6, cross-correlation function analyzing section 172 may obtain the maximum cross-correlation function, thereafter subtract a predetermined time $\Delta U (\Delta U < U)$ from time difference $n_p$ corresponding to the maximum cross-correlation function, and generate update information including an index for identifying the obtained time difference $n_s (= n_p - \Delta U)$.

Adaptive filter 130 updates the filter coefficients of adaptive filter 130 according to equation 6 based on the update information that is output from cross-correlation function analyzing section 172. In this case, only the filter coefficients $g_k(n)$ of filter coefficient orders n satisfying $n_s \le n < n_s + U$ are updated with equation 6.

When the input L signal and the input R signal include background noises and the like, the correctness of the cross-correlation function may be lost due to the background noises. For this reason, cross-correlation function analyzing section 172 outputs, to adaptive filter 130, the update information including the indexes for identifying the time differences $n_s (= n_p - \Delta U)$ obtained by subtracting the predetermined time $\Delta U$ from time difference $n_s$ corresponding to the maximum cross-correlation function, so that the update order range reliably includes the filter coefficient order corresponding to time difference $n_s$ representing the maximum cross-correlation function. As a result, the amount of operation can be reduced, and the reduction of the prediction performance of adaptive filter 130 can be avoided.

[Example of Determination of Update Order Range #3]

Figure 7:
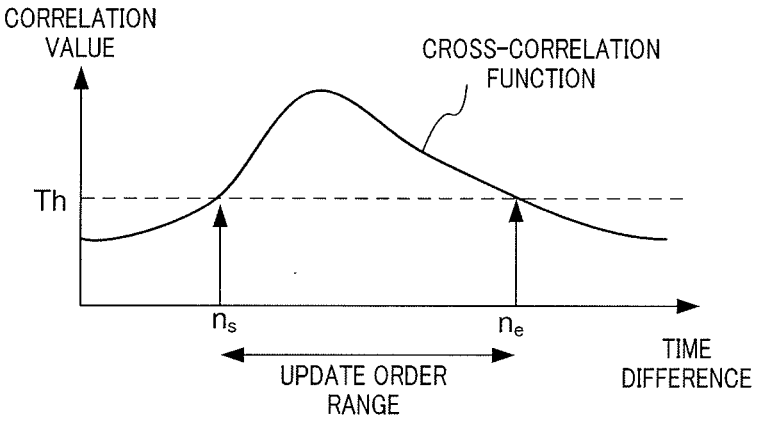
FIG. 7 is a figure for illustrating a determining method for determining an update order range of the filter coefficient of the adaptive filter.

As shown in FIG. 7, cross-correlation function analyzing section 172 may obtain time difference $n_s$ and time difference $n_e$ corresponding to the start and the end of the cross-correlation function greater than a predetermined threshold value Th, and generate update information including indexes for identifying time difference $n_s$ and time difference $n_e$.

Adaptive filter 130 updates the filter coefficients of adaptive filter 130 according to equation 7 based on the update information that is output from cross-correlation function analyzing section 172.

(Equation 7)

$$g_{k+1}(n) = g_k(n) + \frac{\alpha}{\sum_{i=0}^{N-1} L_{dec}(i)^2 + \beta} \cdot R_{e_dec}(k) \cdot L_{dec}(n) \ (n_s \le n < n_e) \quad [7]$$

In this case, only the filter coefficients $g_k(n)$ of filter coefficient orders n satisfying $n_s \le n < n_e$ are updated with equation 7. Therefore, like [Example of determination #1] and [Example of determination #2], the amount of operation can be greatly reduced in contrast to the conventional technique in which all the filter coefficients are updated. Moreover, the filter coefficients of adaptive filter 130 that are included in important sections representing the acoustic characteristic are updated, and therefore, the reduction of the prediction performance of adaptive filter 130 can be avoided.

Figure 8:
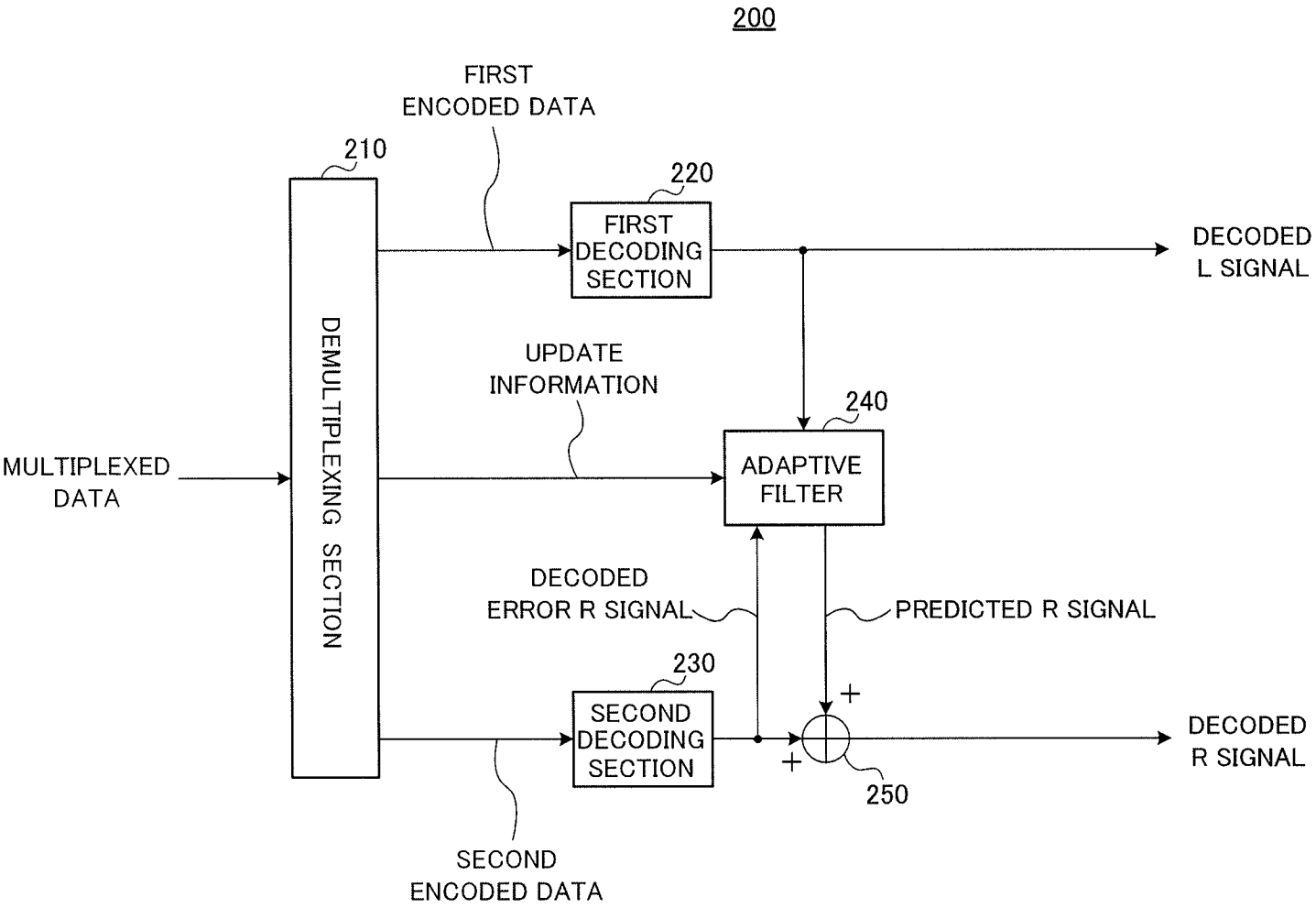
FIG. 8 is a block diagram illustrating a configuration of an essential portion of a decoding apparatus according to Embodiment 1.

FIG. 8 illustrates a configuration of an essential portion of a decoding apparatus according to the present embodiment. Decoding apparatus 200 of FIG. 8 receives multiplexed data transmitted from encoding apparatus 100 of FIG. 2.

Demultiplexing section 210 demultiplexes the multiplexed data into the first encoded data, the second encoded data, and the update information, outputs the first encoded data to first decoding section 220, outputs the second encoded data to second decoding section 230, and outputs the update information to adaptive filter 240.

First decoding section 220 performs decoding processing on the first encoded data, and generates the decoded L signal. First decoding section 220 outputs the decoded L signal to adaptive filter 240 and a data processing section, not shown.

Second decoding section 230 performs decoding processing on the second encoded data, and generates the decoded error R signal. Second decoding section 230 outputs the decoded error R signal to addition section 250 and adaptive filter 240.

Like adaptive filter 130 of encoding apparatus 100, adaptive filter 240 performs filter processing on the decoded L signal, generates a predicted R signal, and outputs the generated predicted R signal to addition section 250. A generation method for generating the predicted R signal in adaptive filter 240 is the same as the generation method in adaptive filter 130 of encoding apparatus 100, and therefore description thereabout will not repeated here.

Like adaptive filter 130 of encoding apparatus 100, adaptive filter 240 updates the filter coefficients of adaptive filter 240 based on the decoded L signal, the decoded error R signal, and the update information. An update method for updating the filter coefficients is the same as the update method in adaptive filter 130 of encoding apparatus 100, and therefore description thereabout will not repeated here.

Addition section 250 adds the predicted R signal and the decoded error R signal, generates the decoded R signal, and outputs the generated decoded R signal to a data processing section, not shown.

According to the above configuration, the decoding apparatus also limits, to an appropriate range, the filter coefficient orders of which filter coefficients are updated, and therefore, the amount of operation can be greatly reduced while the reduction of the prediction performance is prevented.

As described above, according to the present embodiment, update range determining section 170 determines the range of the filter coefficient orders of the filter coefficients to be updated (update order range) among filter coefficients $g_k(n)$ of adaptive filter 130 based on the cross-correlation function between the input L signal and the input R signal, and generates the update information representing the determined update order range. Adaptive filter 130 and adaptive filter 240 use the decoded L signal and the decoded error R signal to update filter coefficients $g_k(n)$ of filter coefficient orders n in the update order range set based on the update information.

Accordingly, adaptive filter 130 and adaptive filter 240 update the filter coefficients included in the important sections representing the acoustic characteristic, but exclude the filter coefficients having small effect on the acoustic characteristic from the target of update, so that the amount of operation required to update the filter coefficients can be reduced while the prediction performances of adaptive filter 130 and adaptive filter 240 are maintained.

In the explanation about present Embodiment, for example, decoding apparatus 200 receives the multiplexed data transmitted from encoding apparatus 100. However, the present invention is not limited to this. It is to be understood that decoding apparatus 200 can operate as long as the multiplexed data is transmitted from an encoding apparatus having other configuration capable of generating the multiplexed data having data required in decoding apparatus 200.

Embodiment 2

In Embodiment 1, encoding apparatus 100 uses the cross-correlation function between the input right channel signal and the input left channel signal to determine the range of the filter coefficient orders of the filter coefficients to be updated (update order range) among filter coefficients $g_k(n)$ of adaptive filter 130. Therefore, it is necessary for encoding apparatus 100 to notify decoding apparatus 200 of information about the determined update order range (update information).

In present Embodiment, encoded data obtained by performing the encoding processing, and the obtained two decoded signals are used to calculate a cross-correlation function, whereby the update order range is determined based on the calculated cross-correlation function. Since the decoding apparatus can determine the update order range without receiving the update information from the encoding apparatus by calculating the cross-correlation function using the decoded signals respectively generated by both of the encoding apparatus and the decoding apparatus, the advantages of the present invention can be achieved without increasing the amount of signaling to the decoding apparatus.

Figure 9:
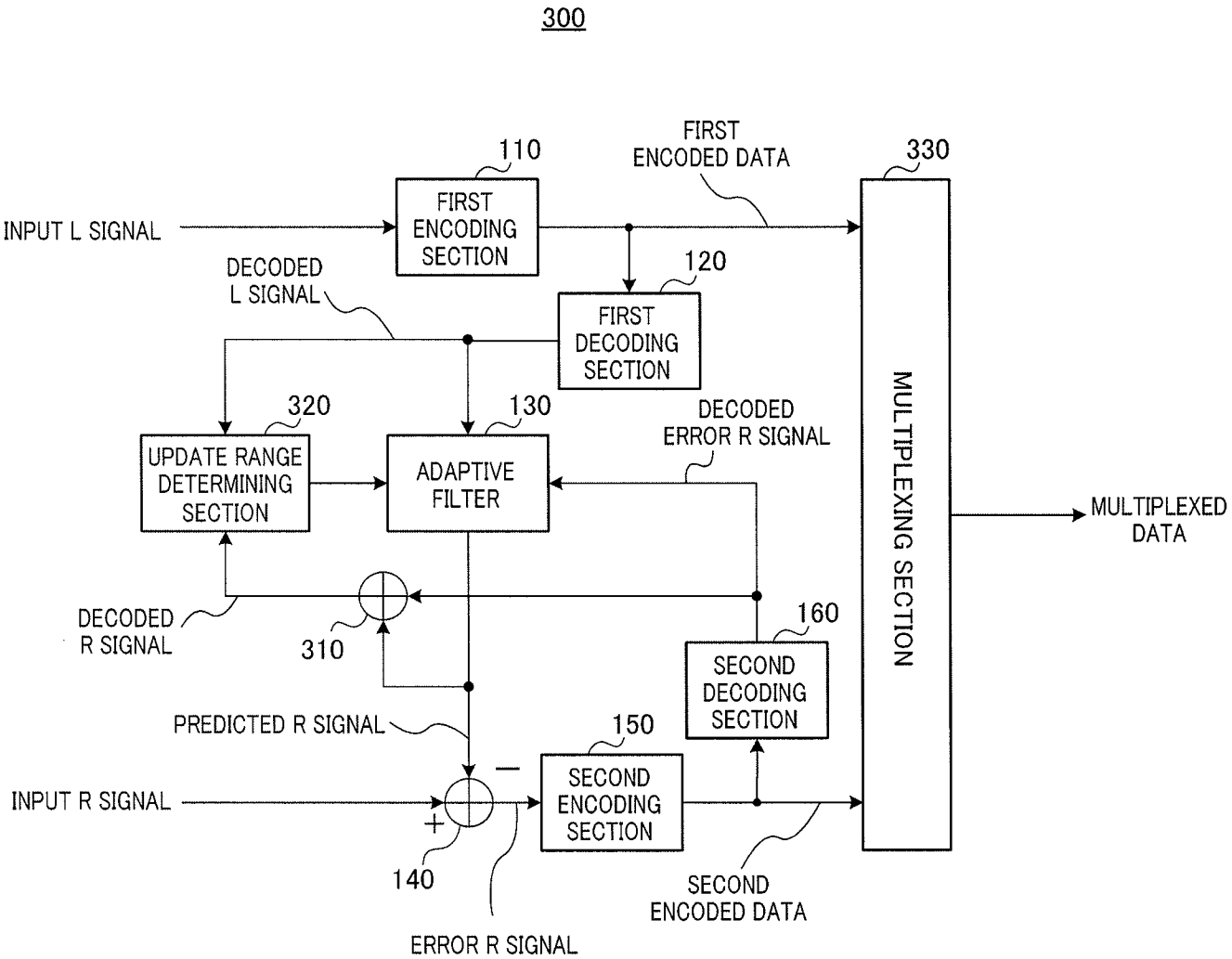
FIG. 9 is a block diagram illustrating a configuration of an essential portion of an encoding apparatus according to Embodiment 2 of the present invention.

FIG. 9 illustrates a configuration of an essential portion of the encoding apparatus according to the present embodiment. It should be noted that the same constituent portions of encoding apparatus 300 of FIG. 9 as those of encoding apparatus 100 of FIG. 2 are denoted with the same reference numerals as those of FIG. 2, and description thereabout will not repeated. Encoding apparatus 300 of FIG. 9 is different from encoding apparatus 100 of FIG. 2 in that encoding apparatus 300 of FIG. 9 has update range determining section 320 and multiplexing section 330 in place of update range determining section 170 and multiplexing section 180, and additionally includes addition section 310.

Addition section 310 adds the predicted R signal and the decoded error R signal, generates the decoded R signal, and outputs the generated decoded R signal to update range determining section 320.

Multiplexing section 330 generates multiplexed data by multiplexing first encoded data and second encoded data, and outputs the generated multiplexed data to a communication path, not shown.

Update range determining section 320 receives a decoded L signal and a decoded R signal instead of receiving the input L signal and the input R signal, and uses the decoded L signal and the decoded R signal to determine the range of the filter coefficient orders of the filter coefficients to be updated (update order range) among filter coefficients $g_k(n)$ of adaptive filter 130. The internal configuration and operation of update range determining section 320 will be hereinafter explained with reference to FIG. 10.

Figure 10:
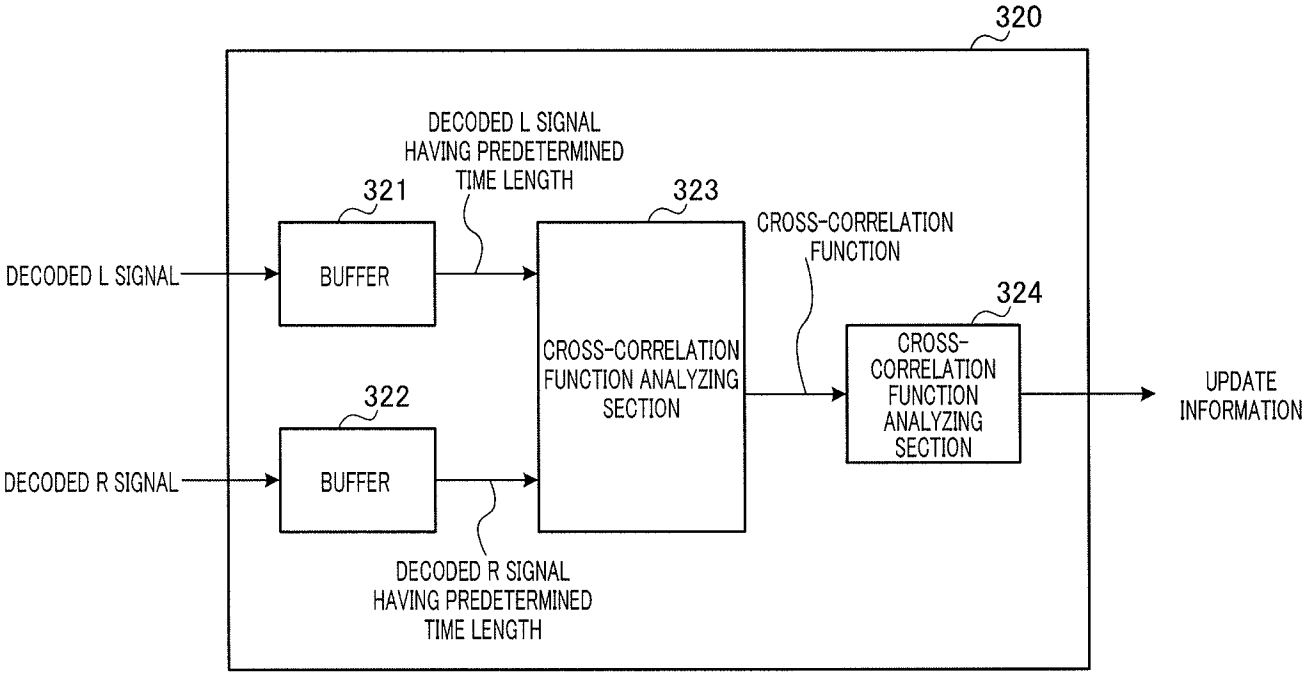
FIG. 10 is a block diagram illustrating an internal configuration of an update range determining section.

FIG. 10 is a block diagram illustrating an internal configuration of update range determining section 320.

Buffer 321 stores the decoded L signal, and outputs the decoded L signal of a predetermined time length to cross-correlation function analyzing section 323.

Likewise, buffer 322 stores the decoded R signal, and outputs the decoded R signal of a predetermined time length to cross-correlation function analyzing section 323.

When the decoded L signal and the decoded R signal stored in buffers 321, 322 are accumulated for the predetermined time length, these signals are output to cross-correlation function analyzing section 323. Thereafter, buffers 321, 322 begin to store the decoded L signal and the decoded R signal for the predetermined time length. As described above, buffers 321, 322 prepare for subsequent processing.

Cross-correlation function analyzing section 323 uses the received decoded L signal and the received decoded R signal to calculate the cross-correlation function. Cross-correlation function analyzing section 323 outputs the calculated cross-correlation function to cross-correlation function analyzing section 324.

Cross-correlation function analyzing section 324 determines the range of the filter coefficient orders of the filter coefficients to be updated (update order range) among filter coefficients $g_k(n)$ of adaptive filter 130. It should be noted that the determining method for determining the update order range is the same as the determining method of cross-correlation function analyzing section 172, and therefore description thereabout will not repeated here. Update range determining section 320 generates update information representing the determined update order range, and outputs the generated update information to adaptive filter 130.

Figure 11:
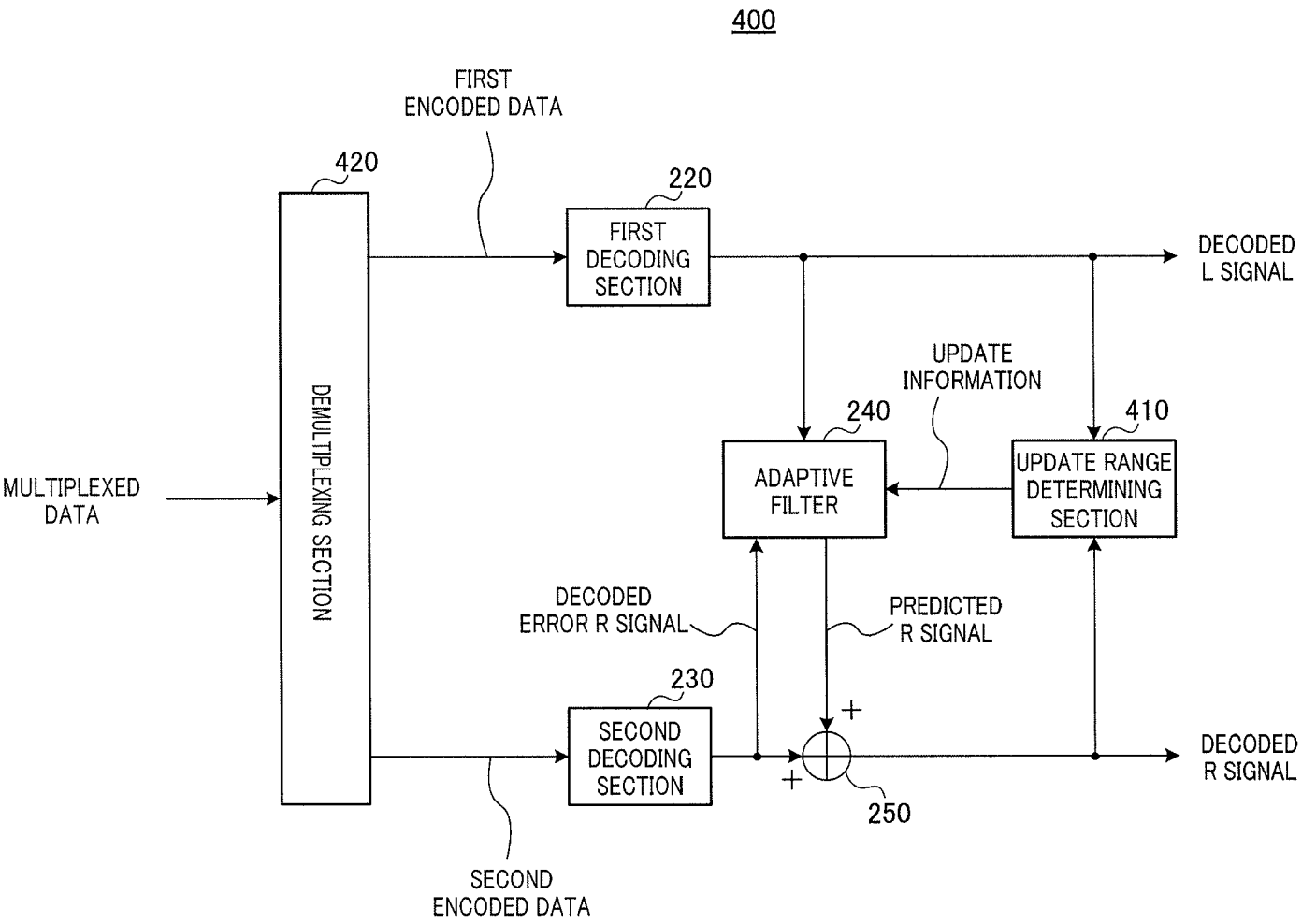
FIG. 11 is a block diagram illustrating a configuration of an essential portion of a decoding apparatus according to Embodiment 2.

FIG. 11 illustrates a configuration of an essential portion of the decoding apparatus according to Embodiment 2. It should be noted that the same constituent portions of decoding apparatus 400 of FIG. 11 as those of decoding apparatus 200 of FIG. 8 are denoted with the same reference numerals as those of FIG. 8, and description thereabout will not repeated. Decoding apparatus 400 of FIG. 11 is different from decoding apparatus 200 of FIG. 8 in that decoding apparatus 400 of FIG. 11 has demultiplexing section 420 in place of demultiplexing section 210, and additionally includes update range determining section 410.

Demultiplexing section 420 demultiplexer the multiplexed data into first encoded data and second encoded data, outputs the first encoded data to first decoding section 220, and outputs the second encoded data to second decoding section 230.

Like update range determining section 320 of encoding apparatus 300, update range determining section 410 receives the decoded L signal and the decoded R signal, and uses the decoded L signal and the decoded R signal to determine the range of the filter coefficient orders of the filter coefficients to be updated (update order range) among filter coefficients $g_k(n)$ of adaptive filter 240. The internal configuration and operation of update range determining section 410 are the same as those of update range determining section 320 of encoding apparatus 300, and therefore description thereabout will not repeated.

As described above, in present Embodiment, update range determining section 320 of encoding apparatus 300 determines the range of the filter coefficient orders of the filter coefficients to be updated (update order range) among filter coefficients $g_k(n)$ of adaptive filter 130 based on the cross-correlation function between the decoded L signal and the decoded R signal. Further, update range determining section 410 of decoding apparatus 400 determines the update order range of adaptive filter 240 to be updated, based on the cross-correlation function between the decoded L signal and the decoded R signal. As a result, even if decoding apparatus 400 does not receive the update information from encoding apparatus 300, decoding apparatus 400 can determine the update order range of adaptive filter 240. Therefore, while the amount of signaling given by encoding apparatus 300 is suppressed, the prediction performance of adaptive filter 130 and adaptive filter 240 can be maintained, and the amount of operation required to update the filter coefficients can be reduced, like Embodiment 1.

As described above, in the explanation about present Embodiment, for example, the update order range is determined for each predetermined time length (e.g. frame).

In the explanation about present Embodiment, for example, decoding apparatus 400 receives the multiplexed data from encoding apparatus 300. However, the present invention is not limited to this. It is to be understood that decoding apparatus 400 can operate as long as the multiplexed data is transmitted from an encoding apparatus having other configuration capable of generating the multiplexed data having data required in decoding apparatus 400.

Embodiment 3

In present Embodiment, the update order range is determined using the filter coefficients of the adaptive filter. More specifically, filter coefficients of the adaptive filter having large amplitudes are deemed to represent an important component of acoustic characteristic, and accordingly only the filter coefficients having large amplitudes are updated. As described above, like Embodiment 2, since the decoding apparatus can determine the update order range without receiving the update information from the encoding apparatus by determining the update order range using the filter coefficients of the adaptive filters respectively configured by both of the encoding apparatus and the decoding apparatus, the advantages of the present invention can be achieved without increasing the amount of signaling to the decoding apparatus.

Figure 12:
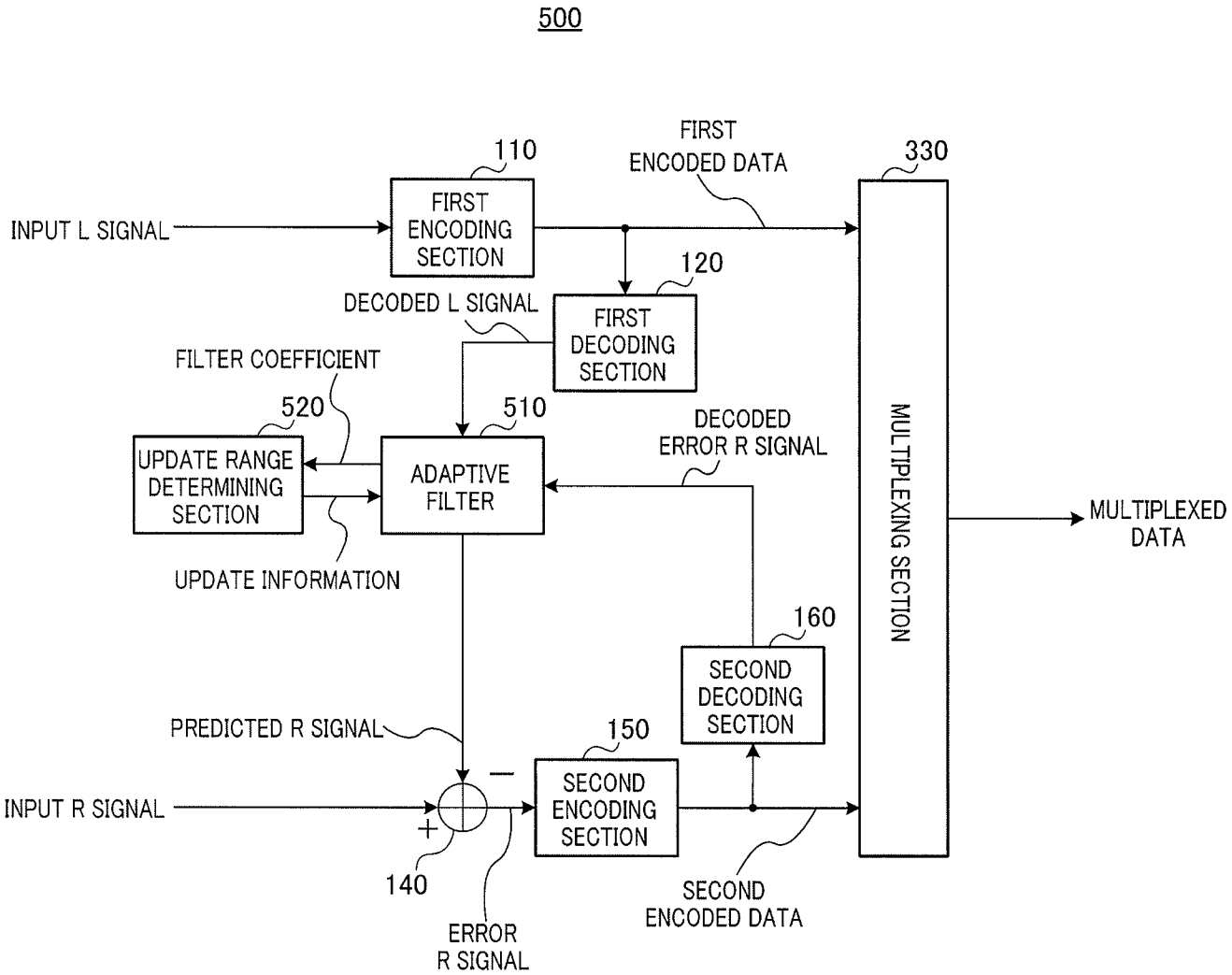
FIG. 12 is a block diagram illustrating a configuration of an essential portion of an encoding apparatus according to Embodiment 3 of the present invention.

FIG. 12 illustrates a configuration of an essential portion of the encoding apparatus according to the present embodiment. It should be noted that the same constituent portions of encoding apparatus 500 of FIG. 12 as those of encoding apparatus 100 of FIG. 2 are denoted with the same reference numerals as those of FIG. 2, and description thereabout will not repeated. Encoding apparatus 500 of FIG. 12 is different from encoding apparatus 100 of FIG. 2 in that encoding apparatus 500 of FIG. 12 has adaptive filter 510, update range determining section 520, and multiplexing section 330 in place of adaptive filter 130, update range determining section 170, and multiplexing section 180.

Multiplexing section 330 generates multiplexed data by multiplexing first encoded data and second encoded data, and outputs the generated multiplexed data to a communication path, not shown.

Like adaptive filter 130, adaptive filter 510 has a transfer function expressed as equation 2, performs filter processing in units of sample processings on the decoded L signal, and generates a predicted R signal. The predicted R signal is generated using equation 4.

After adaptive filter 510 generates and outputs the predicted R signal, adaptive filter 510 outputs filter coefficients $g_k(n)$ of adaptive filter 510 to update range determining section 520.

Update range determining section 520 determines the range of filter coefficient orders n of the filter coefficients to be updated (update order range) among filter coefficients $g_k(n)$ of adaptive filter 510 using filter coefficients $g_k(n)$ of adaptive filter 510. A determining method for determining the update order range will be explained later. Update range determining section 520 outputs information indicating the determined update order range (hereinafter "update information") to adaptive filter 510.

The determining method for determining the update order range in update range determining section 520 and the update method for updating the filter coefficients of adaptive filter 510 will be explained.

First, update range determining section 520 calculates energy of each filter coefficient $g_k(n)$ according to equation 8.

[8]

$$E_g(n)=|g_k(n)|^2 \quad \text{(Equation 8)}$$

In equation 8, $E_g(n)$ denotes the energy of each filter coefficient $g_k(n)$.

Update range determining section 520 determines the range of the filter coefficient orders of the filter coefficients to be updated (update order range) among filter coefficients $g_k(n)$ of adaptive filter 510, based on energy $E_g(n)$ of each filter coefficient $g_k(n)$.

More specifically, update range determining section 520 detects the maximum value of energy $E_g(n)$, and obtains filter coefficient order $n_{sn}$ when the energy $E_g(n)$ attains the maximum value. Then, update range determining section 520 generates update information including indexes (symbol, number) for identifying the filter coefficient order $n_{sn}$.

Adaptive filter 510 updates the filter coefficients of adaptive filter 510 according to equation 9 based on the update information that is output from update range determining section 520.

(Equation 9)

$$g_{k+1}(n) = g_k(n) + \frac{\alpha}{\sum_{i=0}^{N-1} L_{dec}(i)^2 + \beta} \cdot R_{e_dec}(k) \cdot L_{dec}(n) \ (n_{sn} \le n < n_{sn} + U_n) \quad [9]$$

In equation 9, $L_{dec}(n)$ denotes the decoded L signal multiplied with the n-th (filter coefficient order n) filter coefficient $g_k(n)$ of adaptive filter 510, and $R_{e_dec}(k)$ denotes the decoded error R signal at time k. On the other hand, $n_{sn}$ denotes the filter coefficient order included in the update information, and $U_n$ denotes a predetermined number which represents the number of filter coefficients to be updated (the number of updates). In this case, only the filter coefficients $g_k(n)$ of filter coefficient orders n satisfying $n_{sn} \le n < n_{sn}+U_n(=n_{en})$ are updated with equation 9. Therefore, in contrast to the conventional technique in which all the filter coefficients are updated, the amount of operation can be greatly reduced. Moreover, the filter coefficients of adaptive filter 510 that are included in important sections representing the acoustic characteristic are updated, and therefore, the reduction of the prediction performance of adaptive filter 510 can be avoided.

Another method is as follows. Update range determining section 520 may obtain filter coefficient order $n_{pn}$ at which the energy $E_g(n)$ attains the maximum value, thereafter subtract the predetermined number $\Delta U_n(\Delta U_n < U_n)$ from the filter coefficient order $n_{pn}$, and generate update information including an index for identifying the obtained filter coefficient order $n_{sn}(=n_{pn}-\Delta U_n)$. At this occasion, adaptive filter 510 updates the filter coefficients of adaptive filter 510 according to equation 9 based on the update information that is output from update range determining section 520. In this case, only the filter coefficients $g_k(n)$ of filter coefficient orders n satisfying $n_{sn} \le n < n_{sn}+U_n$ are updated with equation 9.

Still another method is as follows. Update range determining section 520 may use predetermined threshold value Th to obtain filter coefficient order $n_{sn}$ and filter coefficient order $n_{en}$ corresponding to the start and the end of the energy larger than threshold value Th, and generate update information including indexes for identifying filter coefficient order $n_{sn}$ and filter coefficient order $n_{en}$. At this occasion, adaptive filter 510 updates the filter coefficients of adaptive filter 510 according to equation 10 based on the update information that is output from update range determining section 520. In this case, only the filter coefficients $g_k(n)$ of filter coefficient orders n satisfying $n_s \le n < n_{en}$ are updated with equation 10.

(Equation 10)

$$g_{k+1}(n) = g_k(n) + \frac{\alpha}{\sum_{i=0}^{N-1} L_{dec}(i)^2 + \beta} \cdot R_{e_dec}(k) \cdot L_{dec}(n) \ (n_{sn} \le n < n_{en}) \quad [10]$$

Figure 13:
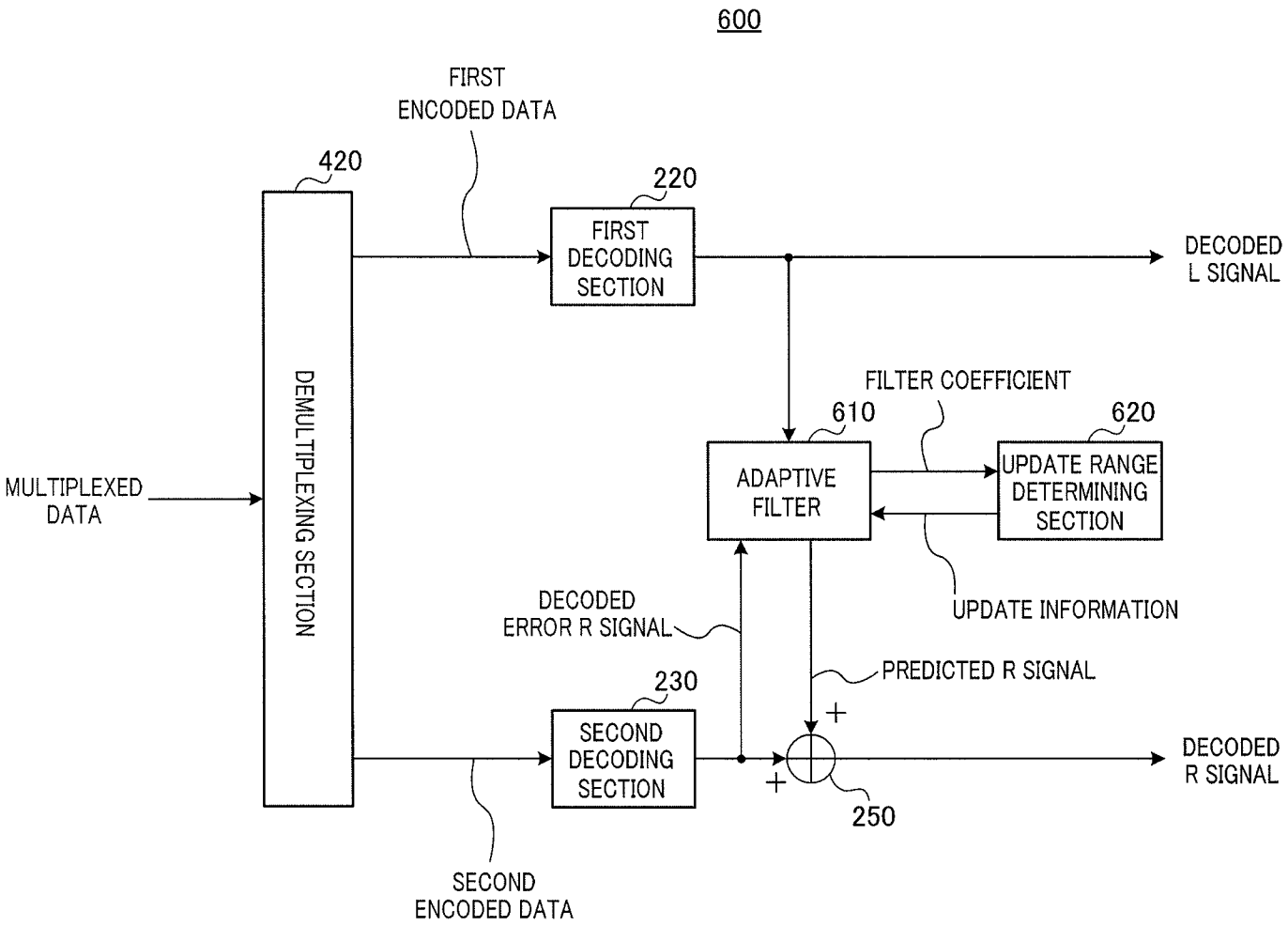
FIG. 13 is a block diagram illustrating a configuration of an essential portion of a decoding apparatus according to Embodiment 3.

FIG. 13 illustrates a configuration of an essential portion of the decoding apparatus according to the present embodiment. Decoding apparatus 600 of FIG. 13 receives the multiplexed data from encoding apparatus 500 of FIG. 12. It should be noted that the same constituent portions of decoding apparatus 600 of FIG. 13 as those of decoding apparatus 400 of FIG. 11 are denoted with the same reference numerals as those of FIG. 11, and description thereabout will not repeated. Decoding apparatus 600 of FIG. 13 is different from decoding apparatus 400 of FIG. 11 in that decoding apparatus 600 of FIG. 13 has adaptive filter 610 and update range determining section 620 in place of adaptive filter 240 and update range determining section 410.

Like adaptive filter 510 of encoding apparatus 500, adaptive filter 610 performs filter processing on the decoded L signal, generates a predicted R signal, and outputs the generated predicted R signal to addition section 250. A generation method for generating the predicted R signal in adaptive filter 610 is the same as the generation method in adaptive filter 510 of encoding apparatus 500, and therefore description thereabout will not repeated here.

Like adaptive filter 510 of encoding apparatus 500, adaptive filter 610 updates the filter coefficients of adaptive filter 610 based on the decoded L signal and the decoded error R signal. An update method for updating the filter coefficients is the same as the update method in adaptive filter 510 of encoding apparatus 500, and therefore description thereabout will not repeated here.

Like update range determining section 520, update range determining section 620 determines the range of filter coefficient orders n of the filter coefficients to be updated (update order range) among filter coefficients $g_k(n)$ of adaptive filter 610 using the filter coefficients of adaptive filter 610. The determining method for determining the update order range is the same as the determining method in update range determining section 520 of encoding apparatus 500, and therefore description thereabout will not repeated here.

As described above, in present Embodiment, update range determining section 520 of encoding apparatus 500 determines the range of the filter coefficient orders of the filter coefficients to be updated (update order range) among filter coefficients $g_k(n)$ of adaptive filter 510 based on the energy of each filter coefficients of adaptive filter 510. Update range determining section 620 of decoding apparatus 600 also determines the update order range of adaptive filter 610 to be updated, based on the energy of each filter coefficient of adaptive filter 610. As a result, even if decoding apparatus 600 does not receive the update information from encoding apparatus 500, decoding apparatus 600 can determine the update order range of adaptive filter 610. Therefore, while the amount of signaling given by encoding apparatus 500 is suppressed, the prediction performance of adaptive filter 510 and adaptive filter 610 can be maintained, and the amount of operation required to update the filter coefficients can be reduced, like Embodiment 1.

In the explanation about present Embodiment, for example, decoding apparatus 600 receives the multiplexed data transmitted from encoding apparatus 500. However, the present invention is not limited to this. It is to be understood that decoding apparatus 600 can operate as long as the multiplexed data is transmitted from an encoding apparatus having other configuration capable of generating the multiplexed data having data required in decoding apparatus 600.

Each Embodiment of the present invention has been hereinabove explained.

In the above explanation, for example, the stereo audio signal (two channel signal) has been explained. However, the present invention can also be applied to the multi-channel audio signal in the same manner. Alternatively, it is to be understood that the input R signal may be a channel used for prediction, and the input L signal may be a predicted channel.

It may be possible to intentionally configure such that the adaptive filter of the decoding section uses less filter coefficients of high orders than the adaptive filter used in the encoding section. Accordingly, the decoded signal may be generated with the lower filter orders in effect. As described above, when the adaptive filter of the decoding section generating the decoded signal is configured not to use filter coefficients of high orders, the sense of reverberation can be reduced, and the quality can be improved.

In the above explanation, the use of NLMS (Normalized Least Mean Square) method has been explained as the method for updating the filter coefficients of the adaptive filter. However, other update methods such as LMS (Least Mean Square) method, projection method, RLS (Recursive Least Squares) method may also be applied.

The above explanations are examples of preferred Embodiments of the present invention, and the scope of the present invention is not limited thereto. The present invention can also be applied to any system having an encoding apparatus and a decoding apparatus.

The encoding apparatus and the decoding apparatus according to the present invention may be incorporated into, for example, a communication terminal apparatus and a base station apparatus in a mobile communication system as a voice encoding apparatus and a voice decoding apparatus. Accordingly, the communication terminal apparatus, the base station apparatus, and the mobile communication system capable of achieving the same actions and effects as described above can be provided.

Also, although cases have been described with the above embodiment as examples where the present invention is configured by hardware, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2009-122147, filed on May 20, 2009, including the specification, drawings, and abstract, is incorporated herein by reference in its entirety.

INDUSTRIAL APPLICABILITY

The encoding apparatus, the decoding apparatus, and the like according to the present invention are suitable for the use in portable telephone, IP telephone, television conference, and the like.

REFERENCE SIGNS LIST

100, 300, 500 Encoding apparatus
110 First encoding section
120, 220 First decoding section
130, 240, 510, 610 Adaptive filter
140 Subtraction section
150 Second encoding section
160, 230 Second decoding section
170, 320, 410, 520, 620 Update range determining section
180, 330 Multiplexing section
171, 323 Cross-correlation function analyzing section
172, 324 Cross-correlation function analyzing section
200, 400, 600 Decoding apparatus
210, 420 Demultiplexing section
250, 310 Addition section
321, 322 Buffer

The invention claimed is:

1. An encoding apparatus, comprising:

a first encoder that generates first encoded information by encoding a first channel signal;

a first decoder that generates a first decoded signal by decoding the first encoded information;

an adaptive filter that performs filter processing on the first decoded signal, and generates a predicted signal of a second channel signal;

an error signal generator that generates an error signal by obtaining an error between the second channel signal and the predicted signal;

a second encoder that generates second encoded information by encoding the error signal; and a second decoder that generates a decoded error signal by decoding the second encoded information, the encoding apparatus further including a determiner that determines, as an update order range, a range of filter coefficient orders of filter coefficients to be updated among filter coefficients used in the filter processing of the adaptive filter, wherein the adaptive filter updates only the filter coefficients of the filter coefficient orders included in the update order range, using the first decoded signal and the decoded error signal.

2. The encoding apparatus according to claim 1, wherein the determiner determines the update order range based on a cross-correlation function between the first channel signal and the second channel signal.

3. The encoding apparatus according to claim 2, wherein the determiner determines, as the update order range, a range of filter coefficient orders, in which a time difference between the first channel signal and the second channel signal is included up to a point that is a predetermined time difference greater than a point representing a maximum value of the cross-correlation function.

4. The encoding apparatus according to claim 2, wherein the determiner determines, as the update order range, a range of filter coefficient orders, in which a time difference between the first channel signal and the second channel signal is included between a point that is a first predetermined time difference smaller than a point representing a maximum value of the cross-correlation function and a point that is a second predetermined time difference larger than a point representing the maximum value of the cross-correlation function, the second predetermined time difference being greater than the first predetermined time difference.

5. The encoding apparatus according to claim 2, wherein the determiner determines, as the update order range, a range of filter coefficient orders in which a time difference between the first channel signal and the second channel signal is included in a range including a point representing a maximum value of the cross-correlation function and in which the cross-correlation function has a greater value than a predetermined threshold value.

6. The encoding apparatus according to claim 1, further comprising:

an adder that generates a second decoded signal by adding the decoded error signal and the predicted signal, wherein the determiner determines the update order range based on a cross-correlation function between the first decoded signal and the second decoded signal of a predetermined time length.

7. The encoding apparatus according to claim 6, wherein the determiner determines, as the update order range, a range of filter coefficient orders in which a time difference between the first decoded signal and the second decoded signal is included up to a point that is a predetermined time difference greater than a point representing a maximum value of the cross-correlation function.

8. The encoding apparatus according to claim 6, wherein the determiner determines, as the update order range, a range of filter coefficient orders in which a time difference between the first decoded signal and the second decoded signal is included between a point that is a first predetermined time difference smaller than a point representing a maximum value of the cross-correlation function and a point that is a second predetermined time difference larger than a point representing the maximum value of the cross- correlation function, the second predetermined time difference being greater than the first predetermined time difference.

9. The encoding apparatus according to claim 6, wherein the determiner determines, as the update order range, a range of filter coefficient orders in which a time difference between the first decoded signal and the second decoded signal is included in a range including a point representing a maximum value of the cross-correlation function and in which the cross-correlation function has a greater value than a predetermined threshold value.

10. The encoding apparatus according to claim 1, wherein the determiner determines the update order range based on energy of filter coefficients used in the filter processing.

11. The encoding apparatus according to claim 10, wherein the determiner determines, as the update order range, a range up to a filter coefficient order that is a predetermined number greater than a filter coefficient order representing the maximum value of the energy from the filter coefficient order representing the maximum value of the energy.

12. The encoding apparatus according to claim 10, wherein the determiner determines, as the update order range, a range from a filter coefficient order that is a first predetermined number smaller than the filter coefficient order representing the maximum value of the energy, up to the filter order coefficient that is a second predetermined number greater, the second predetermined number being greater than the first predetermined number.

13. The encoding apparatus according to claim 10, wherein the determiner determines, as the update order range, a range of filter coefficient orders including a filter coefficient order representing a maximum value of the energy and in which the energy has a greater value than a predetermined threshold value.

14. A communication terminal apparatus, comprising:

the encoding apparatus according to claim 1.

15. A base station apparatus, comprising:

the encoding apparatus according to claim 1.

16. An encoding method, comprising:

generating first encoded information by encoding a first channel signal;

generating a decoded signal by decoding the first encoded information;

performing filter processing on the decoded signal, and generating a predicted signal of a second channel signal;

generating an error signal by obtaining an error between the second channel signal and the predicted signal;

generating second encoded information by encoding the error signal;

generating a decoded error signal by decoding the second encoded information;

determining, as an update order range, a range of filter coefficient orders of filter coefficients to be updated among filter coefficients used in the filter processing of an adaptive filter; and updating only the filter coefficients of the filter coefficient orders included in the update order range, using the decoded signal and the decoded error signal.

17. A decoding apparatus receiving the first encoded information and the second encoded information from the encoding apparatus according to claim 1, the decoding apparatus comprising:

a first decoder that generates a first decoded signal by decoding the first encoded information relating to a first channel signal;

an adaptive filter that generates a predicted signal by performing filter processing on the first decoded signal;

a second decoder that generates a decoded error signal by decoding the second encoded information relating to a second channel signal; and an adder that generates a second decoded signal by adding the decoded error signal and the predicted signal, wherein the adaptive filter uses the first decoded signal and the decoded error signal to update filter coefficients of filter coefficient orders included in a received update order range of filter coefficient orders among the filter coefficients used in the filter processing.

18. The decoding apparatus according to claim 17, wherein the adaptive filter updates the filter coefficients based on the update order range included in a signal received from a communication path.

19. The decoding apparatus according to claim 17, further comprising:

a determiner that determines the update order range based on a cross-correlation function between the first decoded signal and the second decoded signal of a predetermined time length, wherein the adaptive filter updates the filter coefficients based on the update order range provided from the determiner.

20. The decoding apparatus according to claim 17, further comprising:

a determiner that determines the update order range based on energy of the filter coefficients, wherein the adaptive filter updates the filter coefficients based on the update order range provided from the determiner.

21. A communication terminal apparatus, comprising:

the decoding apparatus according to claim 17.

22. A base station apparatus, comprising:

the decoding apparatus according to claim 17.

23. A decoding method executed by a decoding apparatus receiving the first encoded information and the second encoded information from the encoding apparatus according to claim 1, the decoding method comprising:

generating a first decoded signal by decoding the first encoded information relating to a first channel signal;

generating a predicted signal by performing filter processing on the first decoded signal;

generating a decoded error signal by decoding the second encoded information relating to a second channel signal;

generating a second decoded signal by adding the decoded error signal and the predicted signal, using the first decoded signal and the decoded error signal to update filter coefficients of filter coefficient orders included in a specified update order range of filter coefficient orders among the filter coefficients used in the filter processing.

24. The encoding apparatus according to claim 1, further comprising:

a multiplexer that multiplexes the first encoded information, the second encoded information, and the updated order range into multiplexed information, and outputs the multiplexed information.

25. The encoding method according to claim 16, further comprising:

multiplexing the first encoded information, the second encoded information, and the updated order range into multiplexed information, and outputting the multiplexed information.

* * * * *